United States Patent [19]

Crino

[11] 3,982,083

[45] Sept. 21, 1976

[54] CONTACT SYSTEM FOR AN OUTDOOR ELECTRICAL SWITCH

[75] Inventor: Arthur D. Crino, Tigard, Oreg.

[73] Assignee: Allis-Chalmers Corporation, Milwaukee, Wis.

[22] Filed: Oct. 28, 1975

[21] Appl. No.: 625,859

[52] U.S. Cl. ..... 200/48 A; 200/238

[51] Int. Cl.[2] ..... H01B 31/00

[58] Field of Search ..... 200/48 A, 48 R, 48 SB, 200/238

[56] References Cited

UNITED STATES PATENTS 3,388,225 6/1968 Foti ..... 200/48 A

*Primary Examiner*—Herman T. Hohauser

*Attorney, Agent, or Firm*—Robert C. Jones

[57] ABSTRACT

Providing the contact spacer of a high voltage outdoor switch with a reduced number of inboard contacts to reduce the friction experienced in opening and closing the switch without reducing the switch rating.

5 Claims, 2 Drawing Figures

CONTACT SYSTEM FOR AN OUTDOOR ELECTRICAL SWITCH

BACKGROUND OF THE INVENTION

This invention relates to electric switches and more particularly to the contact structure of a ground switch contact spacer. Generally, the pivotal blade type of ground switch includes a blade having one end pivotally attached to a fixed support and having an end adapted to swing about the pivot to a position between contacts of a contact spacer mounted on another support. In order to overcome the high friction forces experienced upon the engagement of the blade with the contacts of the contact spacer present designs impart a twist-in effect to the blade to forcefully engage the blade contact with the contacts of the contact spacer. The twist-in effect imparted to the blade is to reduce the operating effort required to open and close the switch. However, the mechanism required to effect the twist-in of the blade is both costly and complicated.

SUMMARY OF THE INVENTION

In accordance with the present invention, an outdoor high voltage ground switch includes a nontwist switch blade and a special arrangement of the contacts of the associated contact spacer. To this end the contact spacer has an unequal number of contact fingers on opposite sides. By reducing the number of inboard contact fingers on the contact spacer, the sliding friction to open and close the switch blade is reduced. Thus, higher rated switches can be designed with this less costly construction. This construction was conceived upon the full realization of the phenomenon that a typical ground switch forms an L current path through its contact spacer support and blade. From this concept, advantage has been taken of the magnetic forces that occur during a through fault which tend to blow the blade in the direction of the outboard contact fingers. Thus, the outboard contact fingers of the contact spacer experience a greatly increased force at the sacrifice of the inboard contact fingers which serve a limited purpose.

DESCRIPTION OF THE INVENTION

Figure 2:
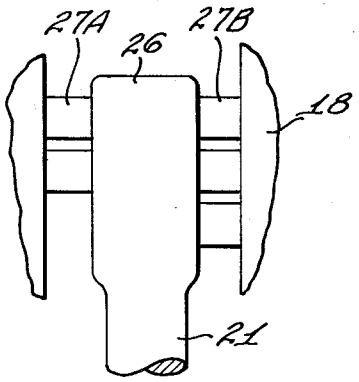
Figure 1:
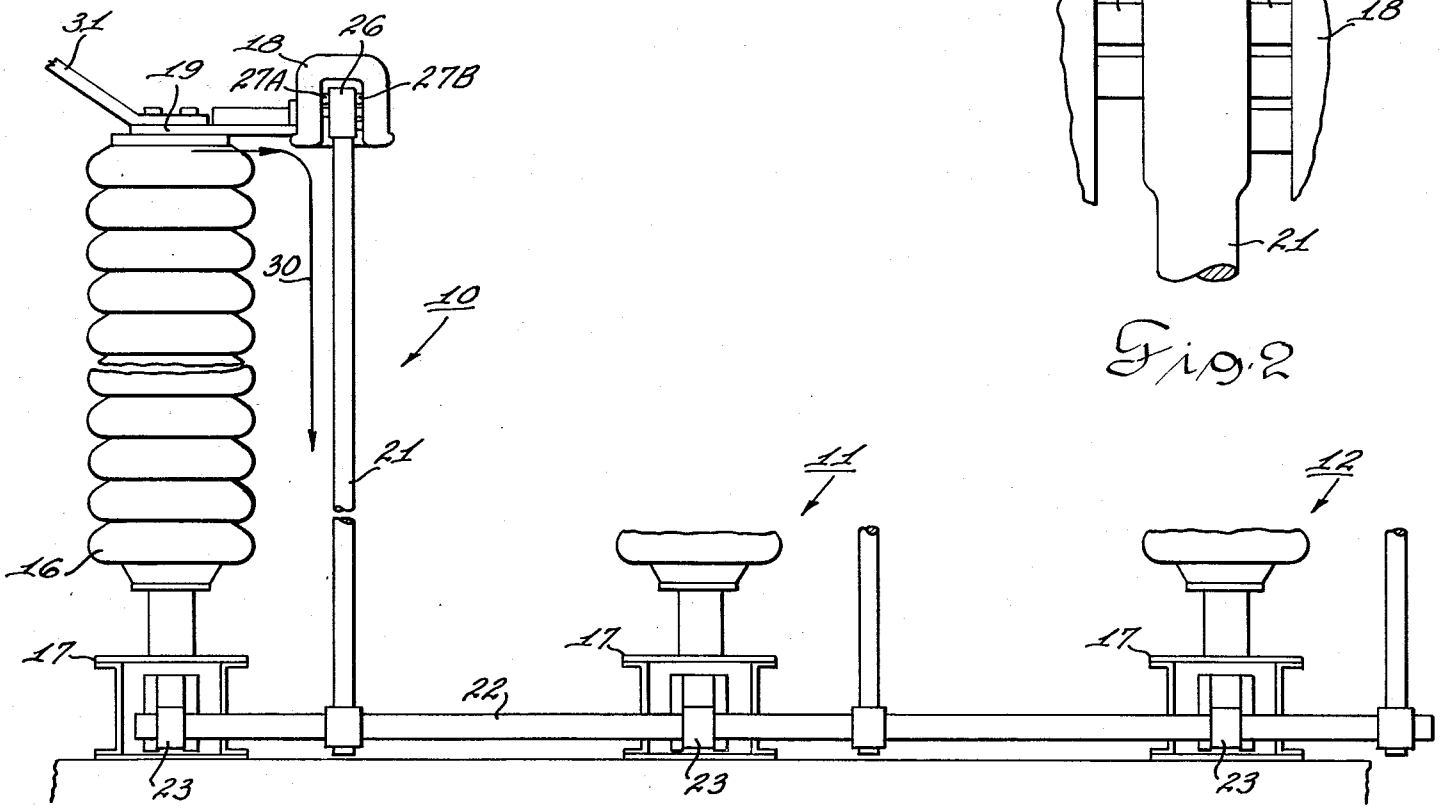
FIG. 1 is a fragmentary view of a three-phase switch installation showing a switch assembly for a single phase of the installation in which the present invention is incorporated; and, FIG. 2 is an enlarged detail view of the contact spacer support showing the inboard and outboard contact finger arrangements.

Referring now to the drawing, there is shown a high voltage outdoor ground switch assembly 10. The switch assembly 10 is depicted as associated with a single phase of a three-phase installation. As shown the other phase assemblies 11 and 12 are identical to the assembly 10 and, thus, the description herein set forth will apply equally as well to the assemblies 11 and 12. As shown, the assembly 10 includes an insulator support 16 which is mounted on a base member 17. The upper end of the insulator support 16 carries a contact spacer support 18 including a terminal pad 19. A movable contact blade 21 is operatively carried on a horizontal shaft 22 which is rotatably carried in brackets 23 secured to the base member 17. The arrangement is such that rotation of the shaft 22, in one direction, by means of an operator (not shown) or manually, will effect the swinging movement of the blade 21, from an open position, upwardly to engage its contact 26 with the spaced apart contact fingers 27 of the contact spacer 18. Conversely, rotation of the shaft 22 in the opposite direction will effect the swinging movement of the blade arm away from the contact spacer 18 to a disengaged or open position.

As depicted a high voltage line 31 is electrically secured to the terminal pad 19. Thus, with the blade 21 in closed position, there is formed an L current path for the through fault current. Such L path is established from the line 31 through the terminal pad 19 and thence to the contact spacer structure 18. The current path continues to the contact spacer structure 18. The current path continues to the contact fingers 27 and through the blade contact 26 and thence to the blade 21 to ground. Thus, of the contact fingers 27, the current makes an L turn to follow the blade.

To reduce the force necessary to effect the swinging movement of the blade 21 into and out of engagement with the finger contacts 27 and to eliminate the twist-in blade mechanism structure arrangement normally provided because of the high friction forces experienced between the blade contact 26 and the contact fingers 27, a novel contact finger construction is provided. As shown, the inboard and outboard contact fingers 27A and 27B, respectively, are of uneven configuration with the inboard contact fingers 27A being the less in number. In the present instance, the inboard contact fingers 27A are two in number while the outboard contact fingers 27B are three in number. This arrangement takes advantage of the magnetic forces which tend to blow the blade 21 in an outboard direction. Thus, with the L current path the magnetic forces will blow the blade contact 26 into forceful intimate electrical engagement with the three outboard contact fingers 27B. The inboard contact fingers 27A serve only a limited purpose.

By providing uneven contact finger arrangements, the switch rating will still be maintained, but the operating effort to overcome the high frictional forces experienced between the blade contact 26 and the contact fingers 27 in a switch closing or opening operation is reduced. The blade twist-in device normally associated with the type of switches set forth has been entirely eliminated.

It will be appreciated that while an uneven contact finger arrangement of two inboard contact fingers 27A and three outboard contact fingers 27B are depicted, any uneven configuration of inboard contact fingers with respect to a greater number of outboard contact fingers is intended to be within the scope of this disclosure.

The embodiments of the invention in which an exclusive property or privilege is claimed are defined as follows:

1. In a contact arrangement for an outdoor electrical switch having a blade arm pivotally supported for movement between open and closed positions and constructed and arranged to provide an L current path;

means for carrying the blade for pivotal movement;

a contact finger support carried by said means in position to be engaged by said blade when it is moved to a closed position;

a first set of contact fingers carried by said contact finger support; and a second set of contact fingers carried by said contact finger support in opposing spaced relationship to said first set contact fingers and of a number greater than the number of contact fingers in said first set of contact fingers;

whereby the greater number of contact fingers opposes the magnetic forces on the blade to thereby establish good electrical engagement between the blade and the opposing greater number of contact fingers.

2. A contact arrangement according to claim 1 wherein said first set of contact fingers constitute an inboard set of contact fingers; and said second set of contact fingers constitute an outboard set of contact fingers constructed and arranged to carry the current rating of the switch and to oppose the magnetic forces experienced due to the L current path which tend to blow the blade outwardly.

3. A contact arrangement according to claim 2 wherein said inboard set of contact fingers are less in number with respect to the number of contact fingers of said outboard set of contact fingers.

4. A contact arrangement according to claim 2 wherein said outboard set of contact fingers are greater in number with respect to the number of contact fingers of said inboard set of contact fingers.

5. A contact arrangement according to claim 2 wherein said inboard set of contact fingers and said outboard set of contact fingers have an uneven number of contact fingers with respect to each other with said outboard set of contact fingers having the greatest number of contact fingers.

* * * * *